US008880415B1

(12) United States Patent
Eck et al.

(10) Patent No.: US 8,880,415 B1
(45) Date of Patent: Nov. 4, 2014

(54) HIERARCHICAL ENCODING OF TIME-SERIES DATA FEATURES

(75) Inventors: Douglas Eck, Palo Alto, CA (US); Jay Yagnik, Santa Clara, CA (US)

(73) Assignee: Google Inc., Mountain View, CA (US)

( * ) Notice: Subject to any disclaimer, the term of this patent is extended or adjusted under 35 U.S.C. 154(b) by 340 days.

(21) Appl. No.: 13/316,286

(22) Filed: Dec. 9, 2011

(51) Int. Cl.
*G10L 21/00* (2013.01)

(52) U.S. Cl.
USPC ..... 704/503; 704/500; 704/501; 704/502; 704/504

(58) Field of Classification Search
CPC ... G10L 19/008; G10L 19/00; G10L 19/0208; G10L 19/0204; G10L 19/16; G10L 19/167; G10L 19/24; G10L 21/04; G10L 21/038
USPC ..... 704/500–504
See application file for complete search history.

(56) References Cited

U.S. PATENT DOCUMENTS

| | | | | |
|---|---|---|---|---|
| 2010/0086221 | A1 * | 4/2010 | Stankiewicz et al. | 382/224 |
| 2011/0077945 | A1 * | 3/2011 | Ojala et al. | 704/262 |
| 2011/0119210 | A1 * | 5/2011 | Zhang et al. | 706/12 |
| 2012/0039270 | A1 * | 2/2012 | Nguyen et al. | 370/329 |

OTHER PUBLICATIONS

Yagnik, Jay, et al. "The Power of Comparative Reasoning", http://www.cs.utoronto.ca/~dross/YagnikStrelowRossLin_ICCV2011.pdf, 8 pages, Nov. 2011.

* cited by examiner

*Primary Examiner* — Leonard Saint Cyr
(74) *Attorney, Agent, or Firm* — Lowenstein Sandler LLP

(57) ABSTRACT

A computing device identifies a first codeword in a first codebook to represent short-timescale information of frames in a time-based data item segmented at intervals and identifies a second codeword in a second codebook to represent long-timescale information of the frames. The computing device generates a third codebook based on the first codeword and the second codeword for the frames to add long-timescale information context to the short-timescale information of the frames.

23 Claims, 6 Drawing Sheets

K = 4, θ = (1, 4, 2, 5, 0, 3)

HIERARCHICAL ENCODING OF TIME-SERIES DATA FEATURES

TECHNICAL FIELD

Embodiments of the present invention relate to the field of representations of time-series data and, more particularly, to a technique of performing hierarchical encoding of time-series data features.

BACKGROUND

Time-series data is data measured typically at successive times spaced at uniform time intervals. Examples of time-series data can include audio data, video data, stock data, metrology data (e.g., daily rainfall, wind speed, temperature), economic data (e.g., monthly profits), sociology data (e.g., crime rate), etc. Traditionally, time-series data analysis systems are designed to extract information from a time-series data item, such as an audio item, and determine properties of the data item from the extracted information.

Many conventional data coding schemes uncover short timescale information. For example, conventional music audio coding schemes can use the extracted information to identify local pitch and timbre. However, current state of the art time-series data analysis systems typically still fail to uncover long-timescale information, such as rhythm and phrasing for audio.

SUMMARY

In one embodiment, a computing device identifies a first codeword in a first codebook to represent short-timescale information of frames in a time-based data item segmented at intervals and identifies a second codeword in a second codebook to represent long-timescale information for the frames. The computing device generates a third codebook based on the first codeword and the second codeword for the frames to add long-timescale information context to the short-timescale information of the frames.

In one embodiment, the time-based data item is an audio data item. In one embodiment, the computing device generates a first codebook using a Winner-Take-All algorithm. In one embodiment, the computing device generates a second codebook by generating, for each frame, a histogram of the codewords from the first codebook that are assigned to the frames within a duration that is associated with a second level in a hierarchy for the time-based data item.

In one embodiment, for each frame, the computing device determines a tensor product of the first codeword and the second codeword of the corresponding frame and generates the third codebook based on the tensor products of the frames. In one embodiment, the computing device generates a histogram of the tensor products for the frames of the time-based data item as a contextual representation of the time-based data item to represent structure of the short-timescale information of the time-based data item in context of the long-timescale information of the time-based data item. In one embodiment, the computing device ranks a time-based data item and/or classifies a time-based data item based on the contextual representation of the time-based data item to provide time-based data item retrieval and/or a time-based data item recommendations.

In additional embodiments, methods for performing the operations of the above described embodiments are also implemented. Additionally, in embodiments of the present invention, a non-transitory computer readable storage medium stores methods for performing the operations of the above described embodiments.

Further, a method for generating a contextual representation of a time-based data item is described. In one embodiment, a method comprises computing a short-timescale vectorial representation for frames in a time-based data item segmented at intervals, creating at least one long-timescale vectorial representation for the frames in the time-based data item, identifying, for the frames in the time-based data item, codewords in a codebook using the short-timescale vectorial representation and the at least one long-timescale vectorial representation for a corresponding frame, and generating a contextual representation of the time-based data item using the codewords for the frames to represent structure of the short-timescale information of the time-based data item in context of the long-timescale information of the time-based data item.

BRIEF DESCRIPTION OF THE DRAWINGS

Various embodiments of the present invention will be understood more fully from the detailed description given below and from the accompanying drawings of various embodiments of the invention.

DETAILED DESCRIPTION

Figure 1:
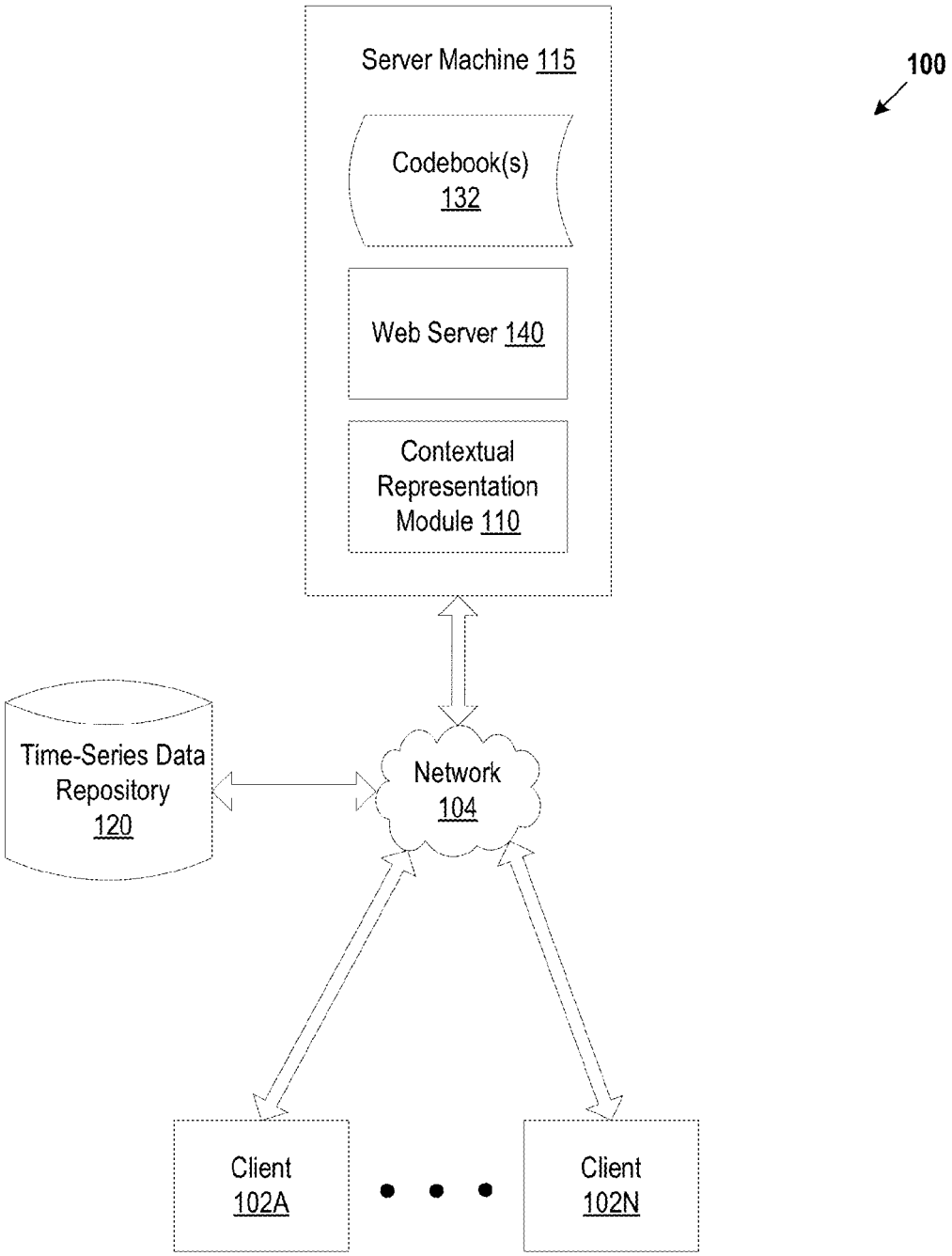
FIG. 1 illustrates exemplary system architecture, in accordance with various embodiments of the present invention.

A system and method for representing short-timescale structure in context of long-timescale structure in time-series data using hierarchical encoding are described. For example, with audio, short-timescale information of drumbeats can be represented in the context of long-timescale information, such as a particular rhythm. Examples of short-timescale information for audio data can include, and are not limited to, local pitch, beat, and timbre, which can be captured using short audio frames (e.g., 10 millisecond audio frames). Examples of long-timescale information for audio data can include, and are not limited to, rhythm and phrasing. Rhythm is movement or procedure with uniform or patterned recurrence of a beat, accent, or the like. In music, rhythm is the pattern of regular or irregular pulses caused in music by the occurrence of strong and weak melodic and harmonic beats, and a phrase is a division of a composition, commonly a passage of four or eight measures, forming part of a period. Phrasing is the grouping of the notes of a musical line into distinct phrases. Long-timescale information for audio, such as rhythm and phrasing, can be captured using long audio segments (e.g., 5 second audio segments) of an audio item.

In an embodiment, the system (or method) identifies a first codeword in a first codebook to represent short-timescale information of frames in a time-based data item segmented at intervals and identifies a second codeword in a second codebook to represent long-timescale information for the frames. Time-based data is also referred to herein as time-series data. Examples of time-series data can include, and are not limited to, audio data, video data, stock data, metrology data (e.g., daily rainfall, wind speed, temperature), economic data (e.g., monthly profits), sociology data (e.g., crime rate), etc. A codebook as referred to herein is a finite set of vectors. Each vector in the codebook is called a code vector or a codeword. The codewords in a codebook are also referred to herein as a vocabulary.

The system generates a third codebook based on the first codeword and the second codeword for the frames to add long-timescale information context to the short-timescale information of the frames. The codewords in the third codebook are contextual codewords that represent short-timescale information in context of long-timescale information. For example, the contextual codewords may represent that 50 of the drumbeats in an audio data item occur next to other drumbeats, 100 of the drumbeats occur next to a guitar chord, and another 50 drumbeats occur with a bass chord.

By providing representations that add long-timescale information context to short-timescale information for time-series data items (e.g., 100 of the drumbeats occur next to a guitar chord), embodiments of the invention greatly improve the quality of time-series based systems, such as content-based music recommendation systems, music retrieval systems, etc. Embodiments discussed herein may be used, for example, for audio representation services, audio recommendation services, audio classification services, audio retrieval services, audio matching services, audio annotation services, cover song detection, etc. For example, songs can be identified that have a drumbeat/rhythm pattern that is similar to a particular song.

FIG. 1 illustrates exemplary system architecture 100 in which embodiments can be implemented. The system architecture 100 includes a server machine 115, a time-series data repository 120 and client machines 102A-102N connected to a network 104. Network 104 may be a public network (e.g., the Internet), a private network (e.g., a local area network (LAN) or wide area network (WAN)), or a combination thereof.

Time-series data repository 120 is a persistent storage that is capable of storing time-series data. As will be appreciated by those skilled in the art, in some embodiments time-series data repository 120 might be a network-attached file server, while in other embodiments time-series data repository 120 might be some other type of persistent storage such as an object-oriented database, a relational database, and so forth. The time-series data stored in the time-series data repository 120 may include user generated content that is uploaded by client machines 102A-102N. The time-series data may additionally or alternatively include content provided by service providers.

The client machines 102A-102N may be personal computers (PC), laptops, mobile phones, tablet computers, or any other computing devices. The client machines 102A-102N may run an operating system (OS) that manages hardware and software of the client machines 102A-102N. A browser (not shown) may run on the client machines (e.g., on the OS of the client machines). The browser may be a web browser that can access content served by a web server. The browser may issue time-series data search queries to the web server or may browse time-series data that have previously been classified. The client machines 102A-102N may also upload time-series data to the web server for storage and/or classification.

Server machine 115 may be a rackmount server, a router computer, a personal computer, a portable digital assistant, a mobile phone, a laptop computer, a tablet computer, a camera, a video camera, a netbook, a desktop computer, a media center, or any combination of the above. Server machine 115 includes a web server 140 and a contextual representation module 110. In alternative embodiments, the web server 140 and contextual representation module 110 may run on different machines.

Web server 140 may serve time-series data from time-series data repository 120 to clients 102A-102N. Web server 140 may receive time-series data search queries and perform searches on the time-series data in the time-series data repository 120 to determine time-series data that satisfy the time-series data search query. Web server 140 may then send to a client 102A-102N those time-series data that match the search query. In one embodiment, web server 140 provides an application that manages time-series data. For example, the application can be a music application or a stock trading application. In one embodiment, an application is provided by and maintained within a service provider environment and provides services relating to time-series data. For example, a service provider maintains web servers 140 to provide audio services, such as audio representation services, audio recommendation services, audio classification services, audio retrieval services, audio matching services, audio annotation services, cover song detection, etc.

In order for the time-series data repository 120 to be searchable, the time-series data in the time-series data repository 120 may be classified. The time-series data repository 120 can include a number of time-series data items. For brevity and simplicity, audio data is used as one example of time-series data throughout this document. For example, the time-series data includes various types of audio, such as, and not limited to, music, sound bites, ring tones, voice messages, and digital audio recordings. An audio item may be a song, a music composition, a sound effect, a voice message or any other collection of sounds. In one embodiment, contextual representation module 110 generates a contextual representation of each of the audio data in the time-series data repository 120 and can use the contextual representations to classify the audio data. The audio data may then be searched based on the contextual representations.

A contextual representation is a representation of short-timescale information within the context of long-timescale information for the time-series data item. The contextual representation module 110 can perform a coarse to fine analysis to create a contextual representation of an audio data item that combines short-timescale information of the audio data item with long-timescale information of the audio data item. The contextual representation module 110 can create a hierarchy of timescale information for an audio data item. In one embodiment, a first level of the hierarchy represents short-timescale information for an audio data item. Other levels of the hierarchy can represent long-timescale information for the audio data item. The contextual representation module 110 can create codebooks 132 or other data structures for the different hierarchy levels and use the hierarchy of codebooks 132 to produce a contextual codebook 132 that combines long-timescale information and short-timescale information in a single representation. One embodiment of creating a contextual codebook is described in greater detail below in conjunction with FIG. 5.

A hierarchy level for an audio data item can be based on time that is associated with the frames of the audio data item.

For example, an audio item is segmented into 10 millisecond (ms) frames. A frame at time t can be represented as frame (t). A first level of the hierarchy can be based on the 10 ms frames. Each 10 ms frame can be also associated with a duration immediately preceding and following time t for the frame. Different durations can be used to define the different long-timescale levels in the hierarchy. For example, a frame (t) with duration of ±500 ms can be a second level of the hierarchy. In another example, a frame (t) with duration of ±2 seconds can be a third level of the hierarchy. In another example, a frame (t) with duration of ±5 seconds can be a fourth level of the hierarchy.

The codewords in the contextual codebook 132 for the audio data item are contextual codewords that add long-timescale context to short-timescale information, for example, to help differentiate between short-timescale sounds occurring within different rhythm. For instance, a first level codebook 132 for the short-timescale information can be used to identify drumbeats of an audio data item. A drumbeat (short-timescale information) can have a different representation depending on the long-timescale information context. The other level codebooks 132 for the long-timescale information can be used to add context to the drumbeats. For instance, if a first level codebook 132 is used to identify 200 drumbeats for a particular audio data item, a second level codebook 132 for a ±500 ms duration may be used to identify that 50 of the 200 drumbeats occur next to other drumbeats, 100 of the 200 drumbeats occur next to a guitar chord, another 50 of the 200 drumbeats occur with a bass chord. In another example, a fourth level codebook 132 for a ±5 seconds duration may be used to identify that 10 of the 200 drumbeats occur in context of "xyz" rhythm and 50 of the 200 drumbeats occur in context of "abc" rhythm.

The contextual representation module 110 can create a histogram of the contextual codewords assigned to the frames of an audio data item as a contextual representation of the audio data item. The contextual representation module 110 can be associated with the corresponding audio data item and stored in the time-series data repository 120.

A web server 140 can access the contextual representations generated by the contextual representation module 110 to provide a service related to time-series data, such as an audio service. For example, a user may wish to retrieve songs that have drumbeats occurring next to a guitar chord. The user can send a request to the web server 140 via a client 102A to identify songs that have a drumbeat/guitar chord pattern that is similar to a particular song. The web server 140 can use the contextual representation of the particular song that is stored in the time-series data repository 120 to identify songs in the time-series data repository 120 that have similar short-timescale and long-timescale information (e.g., drumbeat/guitar chord pattern) as the particular song based on the contextual representations. The web server 140 can rank songs in the time-series data repository 120 based upon the query song using the contextual representation for the songs. The web server 140 can use the contextual representation of the query song to query the time-series data repository 120 for similar tracks based on distance of the vector of the query song against the vectors of the other songs.

Figure 2:
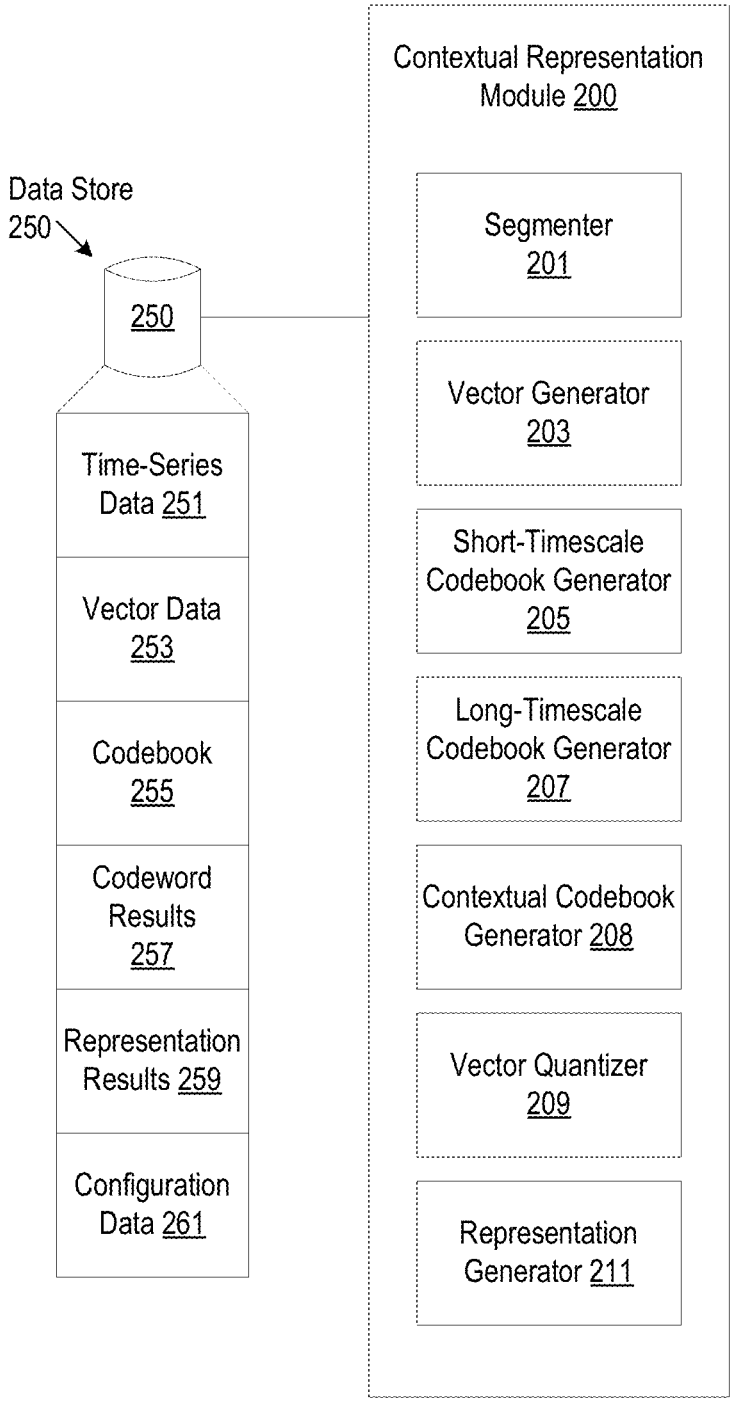
FIG. 2 is a block diagram of a contextual representation module, in accordance with an embodiment.

FIG. 2 is a block diagram of a contextual representation module 200, in accordance with one embodiment of the present invention. The contextual representation module 200 includes a segmenter 201, vector generator 203, short-timescale codebook generator 205, long-timescale codebook generator 207, contextual codebook generator 208, vector quantizer 209, and a representation generator 211. Note that in alternative embodiments, the functionality of one or more of the segmenter 201, vector generator 203, short-timescale codebook generator 205, long-timescale codebook generator 207, contextual codebook generator 208, vector quantizer 209, and a representation generator 211 may be combined or divided.

The contextual representation module 200 can be coupled to a data store 250 that stores time-series data 251 (e.g., time-series data stored in repository 120 in FIG. 1). The segmenter 201 can segment the data items in the data store 250 into short frames at time intervals t within a data item. An interval can be a regular interval or an irregular interval. The segmenter 201 can segment an audio item using an irregular sampling scheme, for example, to capture information around onsets in the audio item. An onset is the beginning of a musical note or other sound, in which the amplitude rises from zero to an initial peak. In one example, the segmenter 201 defines short audio frames for each audio item at regular time intervals t within an audio item. A frame (t) is a frame of the data item at time interval t. A time interval t can be a user-defined value. In one embodiment, a time interval t is a default value, such as 10 ms. For brevity and simplicity, an audio frame is used as one example of a data frame of a time-series data item throughout this document.

The vector generator 203 can compute a short-timescale vectorial representation for each short audio frame of an audio item. The short-timescale vectorial representation is also hereinafter referred to as a first level feature vector. A first level of a hierarchy for an audio item can be for short-timescale information for the audio item. Other levels in the hierarchy can be for long-timescale information for the audio item. A first level feature vector computed at frame (t) can be represented as X[t]. A feature vector can be a k-dimensional vector, where k is a value based on the feature set. The vector generator 203 can extract features at each frame (t) and compute the first level feature vector (e.g., X[t]) for the corresponding frame (t). Examples of features in a spectral feature set, can include, and are not limited to, slope, roll-off, centroid, spread, skew, kurtosis, odd-to-even harmonic energy ratio, and tristimulus. For example, the vector generator 203 generates a first level feature vector X[t] as having k-dimensional spectral features for the 10 ms frame in an audio item. The vector generator 203 can create the first level feature vector for a frame using frequency-domain spectra, log-spectra, compressed spectra, or any encoding method for which the position of the peaks captures the short-timescale information. The first level feature vectors can be stored as part of vector data 253 in the data store 250.

The short-timescale codebook generator 205 can generate a first level codebook for the short-timescale vectorial representations. A codebook for the short-timescale vectorial representations can be represented by a sparse vector of codewords $V=[v_0, v_1, \ldots, v_{\mu-1}]$, V contains μ codewords. A codeword in the first level codebook can be represented by $v_i$. In one embodiment, the short-timescale codebook generator 205 generates a first level codebook having 1000 codewords (a 1000 word vocabulary). In one embodiment, the short-timescale codebook generator 205 uses a sparse coding algorithm, such as a Winner-Take-All (WTA) algorithm, to build a first level codebook. In one embodiment, the short-timescale codebook generator 205 considers a set of groups of spectral dimension that is generated from random permutations. For each group, the short-timescale codebook generator 205 generates a codeword that identifies which spectral dimension within the group has the highest spectral value. The ensemble of these codewords forms a codebook (e.g. a 10 ms-level 1000 codeword vocabulary). One embodiment of generating a first level codebook using WTA is described in greater detail below in conjunction with FIG. 3. In another embodiment, the short-timescale codebook generator 205 uses a k-means clustering algorithm or any other sparse coding algorithm to generate the first level codebook. The generated first level codebook can be stored as part of codebooks 255 in the data store 250.

The vector quantizer 209 can use the generated first level codebook to identify the closest codeword (e.g., $v_i$) in the first level codebook for each frame in the audio data item. The vector quantizer 209 can take an input vector (e.g., X[t]) and evaluate the Euclidean distance between the input vector and each codeword in the first level codebook. When the vector quantizer 209 determines the closest codeword, the vector quantizer 209 stores the index of that codeword or the actual codeword as codeword results 257 in the data store 250.

The long-timescale codebook generator 207 can generate a codebook for long-timescale vectorial representations. Long-timescale codebooks can correspond to long-timescale levels in the hierarchy. For example, long-timescale codebooks may include a second level codebook, a third level codebook, a fourth level codebook, etc. A second level codebook can be represented by a sparse vector of codewords $C=[c_0, c_1, \ldots, c_{\mu-1}]$, C contains μ codewords. A codeword in the second level codebook can be represented by $c_i$. In one embodiment, the long-timescale codebook generator 207 generates a long-timescale codebook (e.g., second level codebook, third level codebook, fourth level codebook, etc.) having 1000 codewords (a 1000 word vocabulary).

In one embodiment, the long-timescale codebook generator 207 generates a long-timescale codebook using short-timescale vectorial representations and autocorrelation. In another embodiment, the long-timescale codebook generator 207 generates a long-timescale codebook by building a histogram of the codewords from a previous level (e.g., the codewords from the first level codebook) that are assigned to the frames within a duration that is associated with the particular level in the hierarchy. For example, a second level in the hierarchy may be associated with a 500 ms duration immediately preceding and immediately following a time t for a frame. The long-timescale codebook generator 207 can identify duration parameters for a level (e.g., second level) in a hierarchy for the audio data item using configuration data 261 that is stored in the data store 250. A hierarchy level can be based on a duration that is associated with the time interval t. The duration can be a user defined valued. For example, the duration for a second level can be the 500 ms immediately preceding time t and the 500 ms immediately following time t. The long-timescale codebook generator 207 generates a second level codebook by building a histogram of the codewords from the first level codebook that are assigned to the frames for a 500 ms duration immediately preceding and immediately following a time t for a frame. The long-timescale codebook generator 207 can generate a histogram for each frame and corresponding duration.

A histogram is a representation of the distribution of data. For example, each codeword in a histogram for creating a long-timescale codebook corresponds to a 10 ms frame in the audio data item and the histogram describes the number of times each codeword occurs within the 500 ms duration immediately preceding and immediately following a particular time t for a frame in the audio item. For instance, the codeword $V_{503}$ from the first level codebook occurs 3 times in the 500 ms duration immediately preceding and immediately following a time t for a frame, and the codeword $v_{781}$ occurs 4 times in the 500 ms duration immediately preceding and immediately following a time t for a frame. The histogram can be a vector. In one embodiment, a vector representation of the histogram has a thousand dimensions.

In one embodiment, the long-timescale codebook generator 207 applies a sparse coding algorithm, such as a WTA algorithm, to the histogram vector representations to build a long-timescale codebook. The ensemble of these codewords forms a long-timescale codebook. For example, the codewords generated for a second level in the hierarchy forms a second level codebook, such as a 1000 codeword vocabulary at ±500 ms. In another embodiment, the codebook generator 207 applies a k-means clustering algorithm to the histogram vector representations to generate the long-timescale codebook. The long-timescale codebook generator 207 can generate a long-timescale codebook for each level in a hierarchy that corresponds to long-timescale information.

The vector quantizer 209 can use a long-timescale codebook to identify the closest codeword in the corresponding codebook for each frame for a corresponding level in the hierarchy. For example, the vector quantizer 209 may use the second level codebook to assign a second level codeword to the frames in the second level (e.g., a frame having ±500 ms duration at time t for the frame). In another example, the vector quantizer 209 may use the third level codebook to assign a third level codeword to the frames in the third level (e.g., a frame having ±2 seconds duration at time t for the frame). In another example, the vector quantizer 209 may use the fourth level codebook to assign a fourth level codeword to the frames in the fourth level (e.g., a frame having ±5 seconds duration at time t for the frame). When the vector quantizer 209 determines the closest codeword, the vector quantizer 209 stores the index of that codeword or the actual codeword as codeword results 257 in the data store.

The contextual codebook generator 208 can generate a contextual codebook that combines long-timescale information and short-timescale information in a single representation. The codewords in the contextual codebook are contextual codewords to add long-timescale context to the short-timescale information for the audio data item. The frames (e.g., 10 ms frames) in the audio item have codewords, which are from different hierarchical codebooks, that are associated with the frames. The contextual codebook generator 208 can combine, for each frame, the codewords that are associated with the frame by taking the tensor product of the codewords. The tensor product is the outer product of two vectors. The tensor product is also referred to as the Kronecker product of more than two vectors.

For example, a frame (t) is associated via vector quantization with two levels of codewords. The first level codeword is $v_{23}$ and the second level codeword is $c_{12}$. The contextual codebook generator 208 takes the tensor product of the two codewords to generate a contextual codeword $v_{23}c_{12}$ for frame (t). A frame may have any number of levels of codewords and the contextual codebook generator 208 can take the Kronecker product of the codewords to generate a contextual codeword for the frame. The ensemble of these contextual codewords for the frames of an audio item forms a contextual codebook. The contextual codebook expands the vocabulary for the audio data item. For example, an audio data item having a first level codebook of 1000 words at 10 ms and a second level codebook of 1000 words at ±500 ms duration expands to a contextual codebook of a vocabulary of 1 million codewords (i.e., 1000×1000).

The representation generator 211 can create a contextual representation of the audio item based on the contextual codewords for the frames of the audio item. In one embodiment, the representation generator 211 creates a histogram of the contextual codewords for the frames for the audio item as the contextual representation of the audio data item. The representation generator 211 can create a contextual representation for each of the data items (e.g., audio data items) in the time-series data 251 in the data store 250. The representation generator 211 can store the histograms in the representation results 259 in the data store 250.

Figure 3:
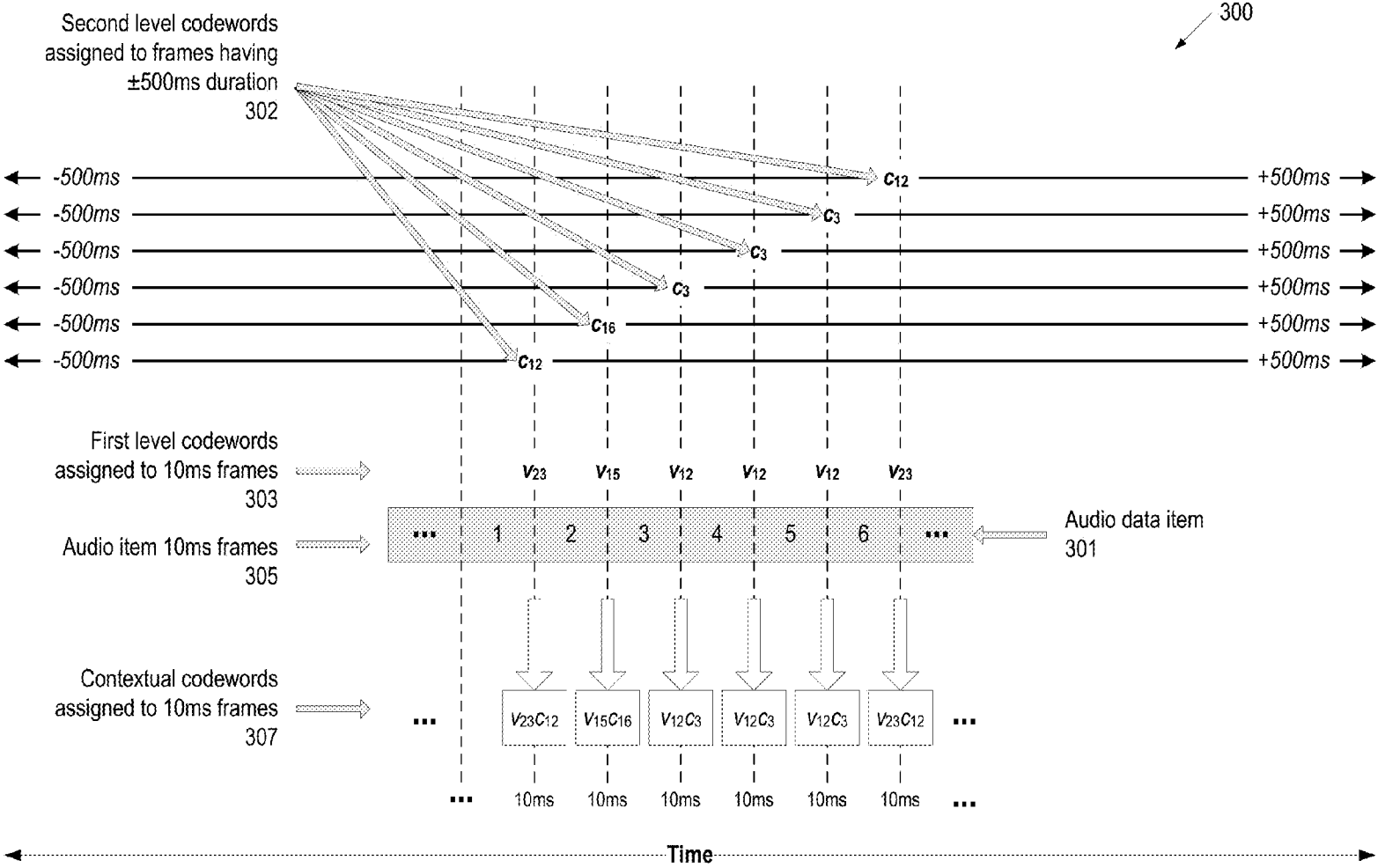
FIG. 3 is a block diagram illustrating the generation of a contextual representation that adds long-timescale information context to short-timescale information for an audio data item using an exemplary two-level hierarchy, in accordance with an embodiment.

FIG. 3 is a block diagram 300 of one embodiment for generating a contextual representation that adds long-timescale information context to short-timescale information for an audio data item using an exemplary two-level hierarchy. An audio data item 301 is segmented into 10 ms frames 305. For example, block diagram 300 shows frames 1-6 for audio data item 301. Spectral features are extracted for each frame to create a first level feature vector for each frame. The first level feature vectors for the frames are encoded using a Winner-Take-All algorithm to generate a first level codebook.

Figure 4:
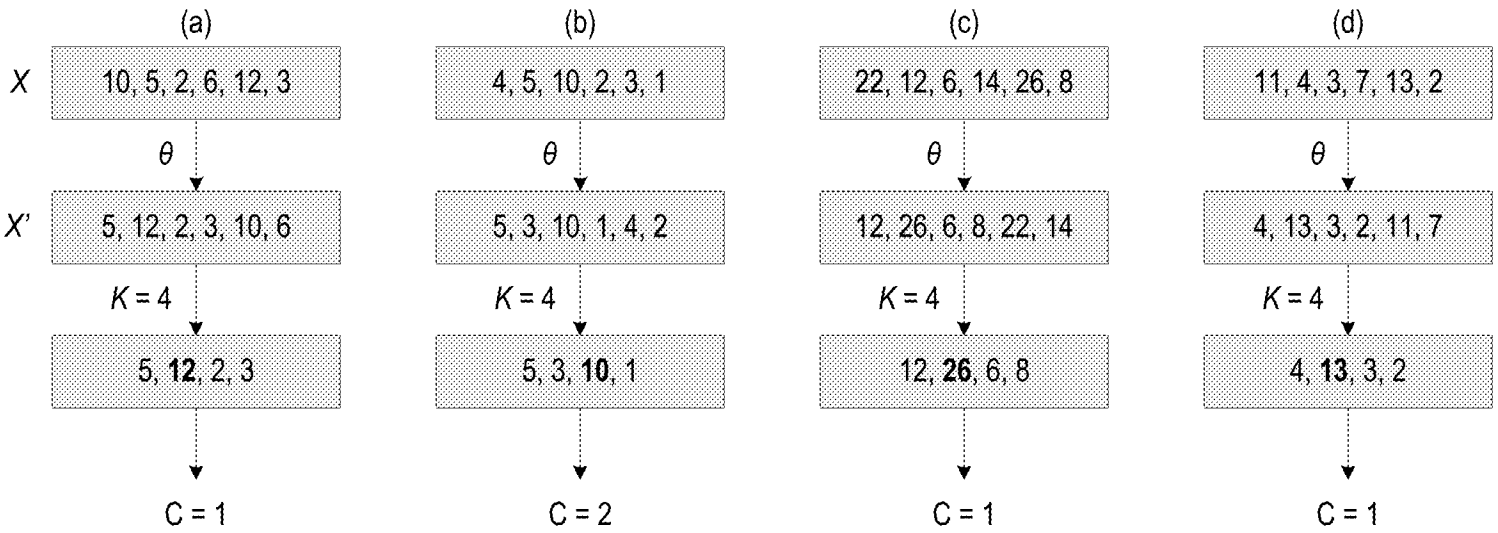
FIG. 4 is a block diagram of an exemplary application of the Winner-Take-All algorithm.

The WTA hash is a sparse embedding method that transforms the input feature space into binary codes such that Hamming distance in the resulting space closely correlates with rank similarity measures. In vector analysis, precise values of each feature dimension (e.g., values in X[t]) are often not important. The WTA algorithm transforms the vector representations (e.g., X[t]) to identify which values in the representations are higher and which ones are lower to create a ranking over these values. The input for the WTA algorithm is set of $\mu$ permutations $\Theta$, window size K, input vector X. The output of the WTA algorithm is sparse vector codes $C_X$. For each permutation $\theta_i$ in $\Theta$, processing logic (a) permutes elements of X according to $\theta_i$ to get X', (b) initializes $i^{th}$ sparse code $c_{xi}$ to 0, and (c) sets $c_{xi}$ to the index of the maximum value in X'(1 . . . K). For j=0 to K−1, if X'(j)>X'($c_{xi}$) then $c_{xi}$=j. The resulting codebook is $C_X=[c_{x0}, c_{x1}, \ldots, c_{x\mu-1}]$, C contains $\mu$ codewords, each taking a value between 0 and K−1. FIG. 4 is a block diagram of an exemplary application of the WTA algorithm to four example input vectors. The WTA algorithm permutes the input feature vectors, takes the first K components from the permuted vectors, and outputs the index of the maximum component. The hashes corresponding to different permutations can be combined into an output hash vector. For example, the input vectors (a, b, c, d) are 6-dimensional input vectors, K=4, and $\theta$=(1, 4, 2, 5, 0, 3). X in (a) and (b) are unrelated and result in different output codes, 1 and 2 respectively. X in (c) is a scaled and offset version of (a) and results in the same code as (a). X in (d) has each element perturbed by 1 which results in a different ranking of the elements, but the maximum of the first K elements is the same, again resulting in the same code.

Returning to FIG. 3, a first level codebook can be generated by determining a size of the first level codebook. In one embodiment, the size of the first level codebook is set as 1000 codewords. A set of groups of spectral dimension that is generated from random permutations can be considered. For example, in creating the first level codebook, a set of groups of X[t] generated from random permutations can be considered. For each group, a code that identifies which spectral dimension within the group has the highest spectral value is generated. The WTA algorithm can be recursively applied until an ensemble of 1000 codewords is identified to form the first level codebook.

The first level feature vectors are vector quantized using the first level codebook to assign the closest matching codeword from the 1000 codewords in the first level codebook to a frame 303. For example, frame 1 is assigned codeword $v_{23}$ from the first level codebook, frame 2 is assigned codeword $v_{15}$, frame 3 is assigned codeword $v_{12}$, frame 4 is assigned codeword $v_{12}$, frame 5 is assigned codeword $v_{12}$, frame 6 is assigned codeword $v_{23}$, etc.

A next level in a hierarchy is identified for the audio data item 301 using configuration data. The next level can be identified by determining a duration parameter for the next level in the configuration data. For example, a second level in a hierarchy for the audio data item 301 is identified as having a duration of 500 ms immediately preceding each frame at time t for the frame and 500 ms immediately following each frame at time t for the frame. A next level feature vector is created for each frame. For example, a second level feature vector is created for t±500 ms for each frame 1-6. In one embodiment, the second level feature vector is created for a frame by auto-correlating the first level feature vector for the frame within t±500 ms for the frame. In another embodiment, the second level feature vector is created for a frame by generating a histogram of the first level codewords that are assigned to the frames within t±500 ms for the frame. For example, the second level feature vector is a histogram for frame (t) indicating that the first level codeword $v_{23}$ occurred 3 times within t±500 ms for the frame (t), first level codeword $v_{15}$ occurred 28 times within t±500 ms for the frame (t), etc. The histogram is a vector that may have a thousand dimensions.

The second level feature vectors for the frames are encoded using, for example, a Winner-Take-All algorithm to generate a second level codebook. The second level codebook can be a 1000 codeword codebook for the t±500 ms frames. The second level feature vectors are vector quantized using the second level codebook to assign the closest matching codeword in the second level codebook to a frame 302. For example, frame 1 is assigned codeword $c_{12}$ from the second level codebook, frame 2 is assigned codeword $c_{15}$, frame 3 is assigned codeword $c_3$, frame 4 is assigned codeword $c_3$, frame 5 is assigned codeword $c_3$, frame 6 is assigned codeword $c_{12}$, etc.

For each frame, the tensor product of the first level codeword and the second level codeword for the frame is taken to produce contextual codewords for the frames 307. For example, the contextual codeword for frame 1 is $v_{23}\ c_{12}$, the contextual codeword for frame 2 is $v_{15}\ c_{16}$, the contextual codeword for frame 3 is $v_{12}\ c_3$, the contextual codeword for frame 4 is $v_{12}c_3$, the contextual codeword for frame 5 is $v_{12}\ c_3$, the contextual codeword for frame 6 is $v_{23}c_{12}$, etc. The contextual codewords for the frames for the audio item form a contextual codebook. A contextual codebook can have a vocabulary size up to the size of the first level codebook multiplied by the size of the second level codebook (e.g., 1000×1000=1,000,000 vocabulary).

A histogram of the contextual codewords for the audio data item 301 can be created as the contextual representation of the audio item 301. For example, the histogram for the audio data item 301 identifies that the contextual codeword $v_{12}\ c_3$ occurred 124 times in the audio data item 301, the contextual codeword $v_{15}\ c_{16}$ occurred 8 times in the audio data item 301, the contextual codeword $v_{23}c_{12}$ occurred 52 times in the audio data item 301, etc.

Figure 5:
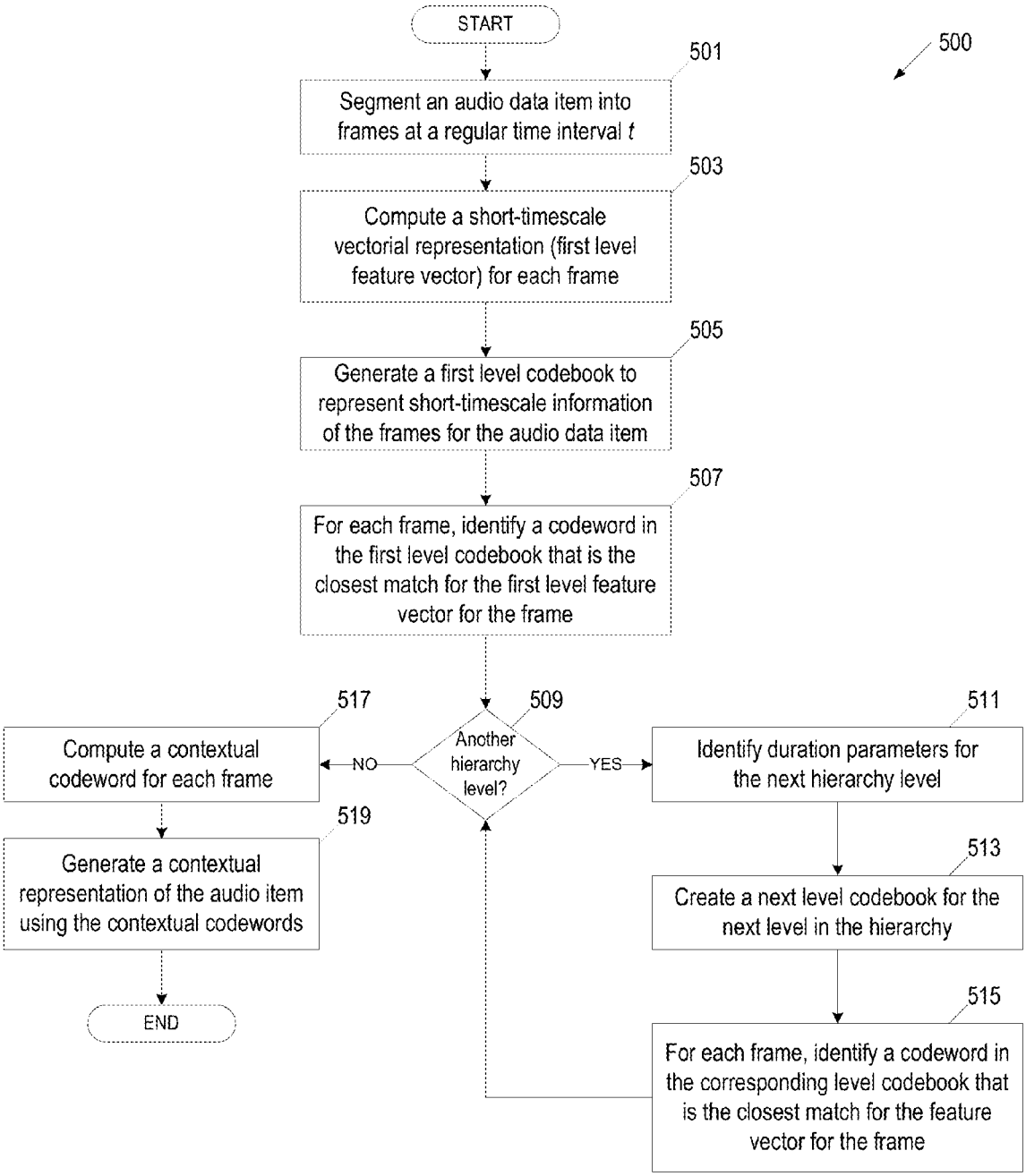
FIG. 5 is a flow diagram illustrating an embodiment for a method of generating a data representation of short-timescale information in context of long-timescale information for a time-series data item using a hierarchical encoding scheme.

FIG. 5 is a flow diagram of an embodiment of a method 500 for generating a data representation of short-timescale information in the context of long-timescale information for a time-series data item using a hierarchy of codebooks. The method 500 is performed by processing logic that may comprise hardware (circuitry, dedicated logic, etc.), software (such as is run on a general purpose computer system or a dedicated machine), or a combination of both. In one embodiment, the method 500 is performed by the server machine 115 of FIG. 1. The method 500 may be performed by a contextual representation module 110 running on server machine 115 or another machine.

At block 501, processing logic segments a time-series data item, such as an audio data item, into frames at a time interval t. The time interval can be a regular interval or an irregular interval. In one embodiment, the time interval t is a regular time interval of 10 ms. In one embodiment, the frames represent a first level of a hierarchy of levels for the audio data item. At block 503, processing logic computes a short-timescale vectorial representation (first level feature vector) for each frame to describe, for example, spectral content within that short frame. A first level feature vector computed at frame (t) can be represented as X[t]. Processing logic can extract features at each frame to compute the first level feature vector at the corresponding frame. Processing logic can use any of frequency-domain spectra, log-spectra, and compressed spectra to create the feature vector for each frame. Examples of features in a spectral feature set, can include, and are not limited to, slope, roll-off, centroid, spread, skew, kurtosis, odd-to-even harmonic energy ratio, and tristimulus.

At block 505, processing logic generates a first level codebook to represent short-timescale information of the frames in the segmented audio data item. In one embodiment, processing logic uses a WTA sparse coding algorithm to encode the first level feature vectors of the frames to generate the first level codebook. Processing logic can also access an existing first level codebook that was previously generated. At block 507, processing logic vector quantizes the first level feature vector for each frame to identify a codeword in the first level codebook that is the closest match for the first level feature vector. Processing logic can take an input vector (e.g., first level feature vector) and evaluate the Euclidean distance between the input vector and each codeword in the first level codebook.

At block 509, processing logic determines whether there is a next level in the hierarchy of levels for the audio data item. A next level can be associated with long-timescale information for the audio data item. In one embodiment, there are two levels in the hierarchy. In other embodiments, there are more than two levels in the hierarchy. Processing logic can determine whether there is a next level in the hierarchy based on configuration data that is stored in a data store that is coupled to the contextual representation module.

If there is a next level in the hierarchy (block 509), for example, a second level, processing logic identifies the duration parameters for the next level of the hierarchy using the configuration data at block 511. A next level can be based on a duration that is associated with the time interval t. The duration can be a user defined value. For example, the duration for a second level can be the 500 ms immediately preceding time t and the 500 ms immediately following time t.

At block 513, processing logic creates a next level codebook vocabulary (long-timescale codebook) for the frames and the duration that is assigned to the next level. For example, processing logic creates a second level codebook to represent the frames and the 500 ms immediately preceding time t and the 500 ms immediately following time t for each frame. In one embodiment, processing logic generates a long-timescale codebook by building a histogram of the codewords from a previous level (e.g., the codewords from the first level codebook) that are assigned to the frames within a duration that is associated with the particular level in the hierarchy. In another embodiment, processing logic generates a long-timescale codebook using short-timescale vectorial representations and autocorrelation. Processing logic can also access an existing current level codebook that was previously generated.

At block 515, processing logic vector quantizes the current level feature vector for each short frame to identify a codeword in the current level codebook that is the closest match for the current level feature vector. For example, processing logic vector quantizes the second level feature vector for each frame to identify a codeword in the second level codebook that is the closest match for the second level feature vector.

Portions of method 500 can be iterative. The number of iterations can be based on the number of levels in the hierarchy for the audio data item. For example, processing logic returns to block 509 to determine whether there is a next level in the hierarchy of levels for the audio data item. If there is a next level in the hierarchy (block 509), for example, a third level, processing logic identifies the duration parameters for the third level of the hierarchy using the configuration data at block 511 and creates a third level codebook vocabulary for the frames and the duration that is assigned to the third level at block 513. For instance, processing logic creates a third level codebook to represent the frames and a duration of 2 seconds immediately preceding time t and the 2 seconds immediately following time t for each frame. Processing logic can identify a codeword in the third level codebook that is the closest match for the third level feature vector at block 515.

If there is not a next level in the hierarchy (block 509), processing logic computes a contextual codeword for each frame by calculating the tensor product of the codewords, which are from the various hierarchical levels, for the frame at block 517. For example, if there are at most two levels in the hierarchy, processing logic calculates, for each frame, the tensor product of the first level codeword for the frame and the second level codeword for the frame. The tensor product result for each frame is a contextual codeword that provides long-timescale information to the short-timescale information. The ensemble of contextual codewords form a contextual codebook.

At block 519, processing logic generates a histogram of the contextual codewords for the frames of the audio data item as the contextual representation of the audio item. A histogram of the contextual codewords for the frames for the entire audio data item represents the structure of the short-timescale information of the audio data item in the context of the long-timescale information of the audio data item.

The contextual codewords can be used in application-dependent ways. For example, the contextual codewords can be concatenated as index keys, used to generate histograms for further application processing, etc. For example, processing logic may identify a time-based data item, such as an audio data item, and can segment the audio data item into frames. Processing logic may compute short-timescale vectorial representation for the frames and may create at least one long-timescale vectorial representation for the frames. Processing logic can use the contextual codewords in the codebook to identify codewords for the frames based on the short-timescale vectorial representation and the long-timescale vectorial representation for the frames. Processing logic can generate a contextual representation of the audio data item using the codewords for the frames to represent structure of the short-timescale information of the audio data item in context of the long-timescale information of the audio data item.

Figure 6:
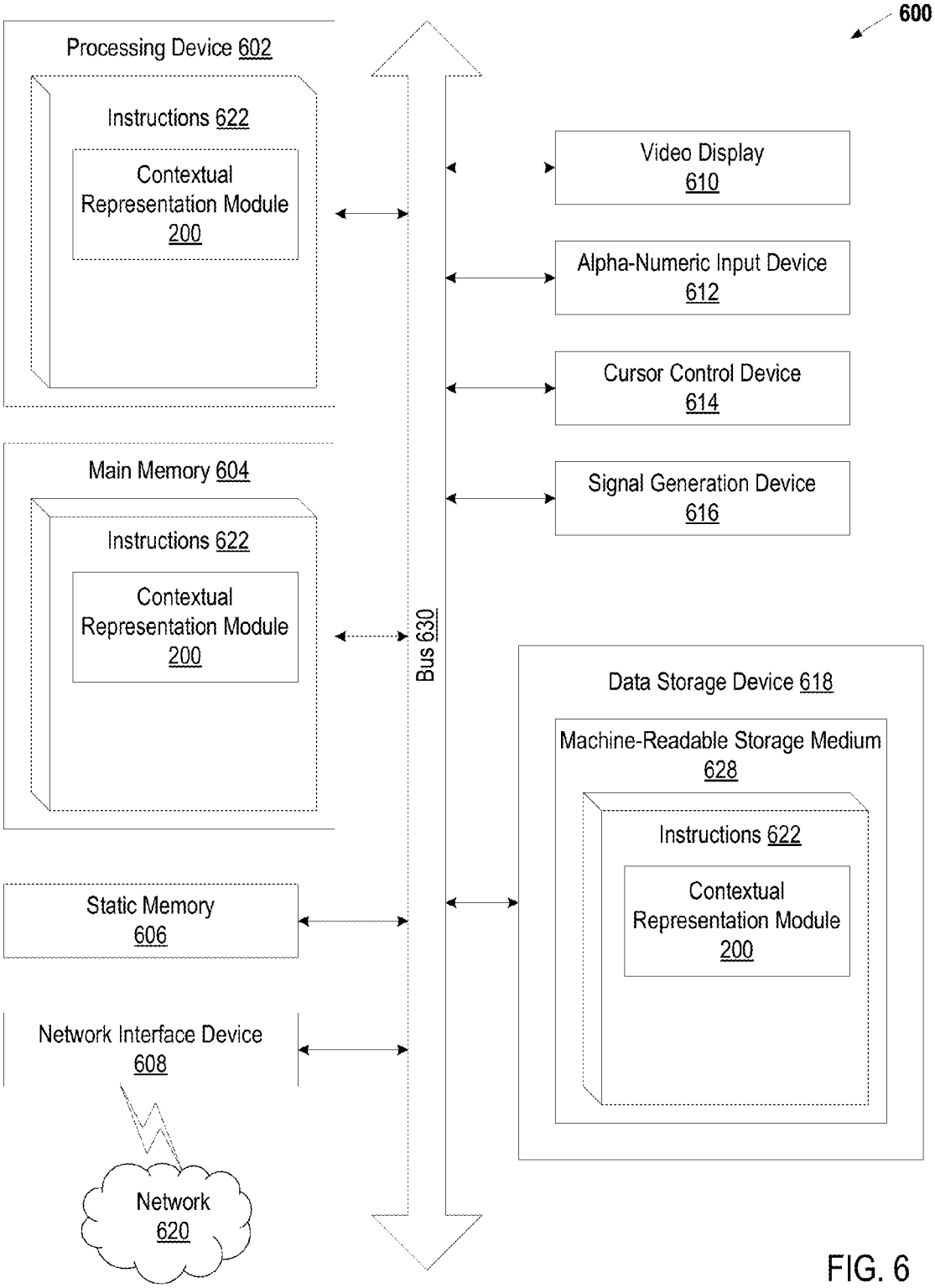
FIG. 6 is a block diagram of an exemplary computer system that may perform one or more of the operations described herein.

FIG. 6 illustrates a diagram of a machine in the exemplary form of a computer system 600 within which a set of instructions, for causing the machine to perform any one or more of the methodologies discussed herein, may be executed. In alternative embodiments, the machine may be connected (e.g., networked) to other machines in a LAN, an intranet, an extranet, or the Internet. The machine may operate in the capacity of a server or a client machine in client-server network environment, or as a peer machine in a peer-to-peer (or distributed) network environment. The machine may be a personal computer (PC), a tablet PC, a set-top box (STB), a Personal Digital Assistant (PDA), a cellular telephone, a web appliance, a server, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The exemplary computer system 600 includes a processing device (processor) 602, a main memory 604 (e.g., read-only memory (ROM), flash memory, dynamic random access memory (DRAM) such as synchronous DRAM (SDRAM), double data rate (DDR SDRAM), or DRAM (RDRAM), etc.), a static memory 606 (e.g., flash memory, static random access memory (SRAM), etc.), and a data storage device 618, which communicate with each other via a bus 630.

Processor 602 represents one or more general-purpose processing devices such as a microprocessor, central processing unit, or the like. More particularly, the processor 602 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The processor 602 may also be one or more special-purpose processing devices such as an application specific integrated circuit (ASIC), a field programmable gate array (FPGA), a digital signal processor (DSP), network processor, or the like. The processor 602 is configured to execute instructions 622 for performing the operations and steps discussed herein.

The computer system 600 may further include a network interface device 608. The computer system 600 also may include a video display unit 610 (e.g., a liquid crystal display (LCD) or a cathode ray tube (CRT)), an alphanumeric input device 612 (e.g., a keyboard), a cursor control device 614 (e.g., a mouse), and a signal generation device 616 (e.g., a speaker).

The data storage device 618 may include a computer-readable storage medium 628 on which is stored one or more sets of instructions 622 (e.g., software) embodying any one or more of the methodologies or functions described herein. The instructions 622 may also reside, completely or at least partially, within the main memory 604 and/or within the processor 602 during execution thereof by the computer system 600, the main memory 604 and the processor 602 also constituting computer-readable storage media. The instructions 622 may further be transmitted or received over a network 620 via the network interface device 608.

In one embodiment, the instructions 622 include instructions for a contextual representation module (e.g., contextual representation module 200 of FIG. 2) and/or a software library containing methods that call a contextual representation module. While the computer-readable storage medium 628 (machine-readable storage medium) is shown in an exemplary embodiment to be a single medium, the term "computer-readable storage medium" should be taken to include a single medium or multiple media (e.g., a centralized or distributed database, and/or associated caches and servers) that store the one or more sets of instructions. The term "computer-readable storage medium" shall also be taken to include any medium that is capable of storing, encoding or carrying a set of instructions for execution by the machine and that cause the machine to perform any one or more of the methodologies of the present invention. The term "computer-readable storage medium" shall accordingly be taken to include, but not be limited to, solid-state memories, optical media, and magnetic media.

In the foregoing description, numerous details are set forth. It will be apparent, however, to one of ordinary skill in the art having the benefit of this disclosure, that the present invention may be practiced without these specific details. In some instances, well-known structures and devices are shown in block diagram form, rather than in detail, in order to avoid obscuring the present invention.

Some portions of the detailed description have been presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "identifying", "generating", "determining", "ranking", "classifying," "computing," "creating," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

The present invention also relates to an apparatus for performing the operations herein. This apparatus may be constructed for the intended purposes, or it may comprise a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method comprising:

identifying, by a computing device, a first codeword in a first codebook to represent short-timescale information of frames in a time-based data item segmented at intervals;

identifying a second codeword in a second codebook to represent long-timescale information of the frames; and generating a third codebook based on the first codeword and the second codeword for the frames to add long-timescale information context to the short-timescale information of the frames.

2. The method of claim 1, wherein the time-based data item is an audio data item.

3. The method of claim 1, further comprising:

generating the first codebook using a Winner-Take-All algorithm.

4. The method of claim 1, further comprising:

generating the second codebook by creating, for each frame, a histogram of the codewords from the first codebook that are assigned to the frames within a duration that is associated with a second level in a hierarchy for the time-based data item.

5. The method of claim 1, wherein generating the third codebook comprises:

determining, for each frame, a tensor product of the first codeword and the second codeword of the corresponding frame; and generating the third codebook based on the tensor products of the frames.

6. The method of claim 5, further comprising:

generating a histogram of the tensor products for the frames of the time-based data item as a contextual representation of the time-based data item to represent structure of the short-timescale information of the time-based data item in context of the long-timescale information of the time-based data item.

7. The method of claim 6, further comprising:

at least one of ranking the time-based data item and classifying the time-based data item based on the contextual representation of the time-based data item to provide at least one of time-based data item retrieval and a time-based data item recommendation.

8. A non-transitory computer readable storage medium encoding instructions thereon that, in response to execution by a computer device, cause the computing device to perform operations comprising:

identifying, by the computing device, a first codeword in a first level codebook to represent short-timescale information of frames in a time-based data item segmented at intervals;

identifying a second codeword in a second level codebook to represent long-timescale information of the frames;

determining, for each frame, a tensor product of the first codeword and the second codeword of the corresponding frame; and generating a third codebook based on the tensor products to add long-timescale information context to the short-timescale information of the frames.

9. The non-transitory computer readable storage medium of claim 8, wherein the time-based data item is an audio data item.

10. The non-transitory computer readable storage medium of claim 8, further comprising:

generating the first level codebook using a Winner-Take-All algorithm.

11. The non-transitory computer readable storage medium of claim 8, further comprising:

generating the second level codebook by creating, for each frame, a histogram of the codewords from the first level codebook that are assigned to the frames within a duration that is associated with a second level in a hierarchy for the time-based data item.

12. The non-transitory computer readable storage medium of claim 8, the operations further comprising:

generating a histogram of the tensor products for the frames of the time-based data item as a contextual representation of the time-based data item to represent structure of the short-timescale information of the time-based data item in context of the long-timescale information of the time-based data item.

13. The non-transitory computer readable storage medium of claim 12, the operations further comprising:

at least one of ranking the time-based data item and classifying the time-based data item based on the contextual representation of the time-based data item to provide at least one of time-based data item retrieval and a time-based data item recommendation.

14. A computing device comprising:

a memory; and a processor coupled to the memory, wherein the processor is configured to:

identify a first codeword in a first codebook to represent short-timescale information of frames in a time-based data item segmented at intervals;

identify a second codeword in a second codebook to represent long-timescale information of the frames; and generate a third codebook based on the first codeword and the second codeword for the frames to add long-timescale information context to the short-timescale information of the frames.

15. The computing device of claim 14, wherein the time-based data item is an audio data item.

16. The computing device of claim 14, wherein the processor is further configured to generate the first codebook using a Winner-Take-All algorithm.

17. The computing device of claim 14, wherein the processor is further configured to:

generate the second codebook by creating, for each frame, a histogram of the codewords from the first codebook that are assigned to the frames within a duration that is associated with a second level in a hierarchy for the time-based data item.

18. The computing device of claim 14, wherein generating the third codebook comprises:

determining, for each frame, a tensor product of the first codeword and the second codeword of the corresponding frame; and generating the third codebook based on the tensor products of the frames.

19. The computing device of claim 18, wherein the processor is further configured to:

generate a histogram of the tensor products for the frames of the time-based data item as a contextual representation of the time-based data item to represent structure of the short-timescale information of the time-based data item in context of the long-timescale information of the time-based data item.

20. The computing device of claim 19, wherein the processor is further configured to:

at least one of rank the time-based data item and classify the time-based data item based on the contextual representation of the time-based data item to provide at least one of time-based data item retrieval and a time-based data item recommendation.

21. A method comprising:

computing, by a computing device, a short-timescale vectorial representation for frames in a time-based data item segmented at intervals;

creating at least one long-timescale vectorial representation for the frames in the time-based data item; and identifying, for the frames in the time-based data item, codewords in a codebook using the short-timescale vectorial representation and the at least one long-timescale vectorial representation for a corresponding frame; and generating a contextual representation of the time-based data item using the codewords for the frames to represent structure of the short-timescale information of the time-based data item in context of the long-timescale information of the time-based data item.

22. The method of claim 21, wherein the time-based data item is an audio data item.

23. The method of claim 21, wherein each codeword in the codebook is a tensor product of a first codeword for short-timescale information and at least one second codeword for long-timescale information.

* * * * *